US006726781B2

(12) United States Patent
Walmer et al.

(10) Patent No.: US 6,726,781 B2
(45) Date of Patent: Apr. 27, 2004

(54) HIGH TEMPERATURE PERMANENT MAGNETS

(75) Inventors: Marlin S. Walmer, deceased, late of Lancaster, PA (US), legal representative, Joanne H. Walmer; Christina H. Chen, Landisville, PA (US); Shiqiang Liu, Springboro, OH (US); Michael H. Walmer, Washington Boro, PA (US); G. Edward Kuhl, Kettering, OH (US)

(73) Assignees: University of Dayton, Dayton, OH (US); Electron Energy Corporation, Landisville, PA (US)

( * ) Notice: Subject to any disclaimer, the term of this patent is extended or adjusted under 35 U.S.C. 154(b) by 27 days.

(21) Appl. No.: 10/241,895

(22) Filed: Sep. 12, 2002

(65) Prior Publication Data

US 2003/0037844 A1 Feb. 27, 2003

Related U.S. Application Data

(63) Continuation of application No. 09/476,664, filed on Jan. 3, 2000, now Pat. No. 6,451,132.
(60) Provisional application No. 60/114,993, filed on Jan. 6, 1999.

(51) Int. Cl.[7] ..... H01F 1/055
(52) U.S. Cl. ..... 148/303; 148/301
(58) Field of Search ..... 148/303, 301, 148/300, 100, 101

(56) References Cited

U.S. PATENT DOCUMENTS

| | | | |
|---|---|---|---|
| 3,748,193 A | | 7/1973 | Cech |
| 3,947,295 A | | 3/1976 | Tawara et al. |
| 3,970,484 A | | 7/1976 | Doser et al. |
| 3,977,917 A | | 8/1976 | Fujimura et al. |
| 4,172,717 A | | 10/1979 | Tokunaga et al. |
| 4,210,471 A | | 7/1980 | Yoneyama et al. |
| 4,211,585 A | | 7/1980 | Inomata et al. |
| 4,213,803 A | | 7/1980 | Yoneyama et al. |
| 4,221,613 A | | 9/1980 | Imaizumi et al. |
| 4,284,440 A | | 8/1981 | Tokunaga et al. |
| 4,289,549 A | | 9/1981 | Kasai |
| 4,375,996 A | | 3/1983 | Tawara et al. |
| 4,382,061 A | | 5/1983 | Herget et al. |
| 4,497,672 A | | 2/1985 | Tawara et al. |
| 4,536,233 A | | 8/1985 | Okonogi et al. |
| 4,565,587 A | | 1/1986 | Narasimhan |
| 4,578,125 A | | 3/1986 | Sahashi et al. |
| 4,746,378 A | | 5/1988 | Wysiekierski et al. |
| 5,772,796 A | | 6/1998 | Kim |
| 5,781,843 A | | 7/1998 | Anderson et al. |
| 6,451,132 B1 | * | 9/2002 | Walmer et al. ..... 148/303 |

OTHER PUBLICATIONS

Das, Dilip K., "Twenty Million Energy Product Samarium–Cobalt Magnet" IEEE Trans. Magn., vol. MAG–5, No. 3, Sep. 1969, pp. 214–216.

Strnal K. and Osterlag, W., "Program for an in–house investigation of the yttrium–cobalt alloy system" Technical Memorandum, May 64–4, Projects 7367 and 7360, AFML, Wright–Patterson AFB, Ohio, Mar. 1964—Not Available.

(List continued on next page.)

*Primary Examiner*—Roy King
*Assistant Examiner*—Harry D. Wilkins, III
(74) *Attorney, Agent, or Firm*—Dinsmore & Shohl LLP

(57) ABSTRACT

A permanent magnet is provided which retains its magnetic properties and exhibits a linear extrinsic demagnetization curve at elevated temperatures up to 700° C. The magnet is represented by the general formula $RE(Co_WFe_VCu_XT_Y)_Z$, where RE is a rare earth metal selected from the group consisting of Sm, Gd, Pr, Nd, Dy, Ce, Ho, Er, La, Y, Tb, and mixtures thereof and T represents a transition metal(s) selected from the group consisting of Zr, Hf, Ti, Mn, Cr, Nb, Mo, W, V, Ni, Ta, and mixtures thereof.

15 Claims, 11 Drawing Sheets

Extrinsic demagnetization curves at $T_M$ for three samples of this invention

OTHER PUBLICATIONS

Fidler, J. et al., "Analytical Electron microscope study of high and low coercivity SmCo 2:17 magnets" Mat. Res. Sol. Sym. Proc., 96, 1987—Not Available.

Popov et al., "Inference of copper concentration on the magnetic properties and structure of alloys" Phys. Met. Metall., 60, (2), 1990, pp. 18–27—Not Available.

Perry, A.J. and Menth, A., "Permanent Magnets Based on Sm(Co,Cu,Fe)z" IEEE Trans. Magn., vol. Mag–11, No. 5, Sep. 1975, pp. 1423–1425.

Ray, A.E., "The Development of High Energy Product Permanent Magnets from 2:17 RE–TM Alloys" IEEE Trans. Magn., vol. Mag–20, No. 5, Sep. 1984, pp. 1614–1618.

Strnat, K. and Hoffer, G., "$YCo_5$—A promising New Permanent Magnet Material" USAF Tech. Doc. Rept., Materials Laboratory, WPAFB AFML–TR–65–446, May 1966.

Strnat K. et al. "A Family of New Cobalt–Base Permanent Magnet Materials" J. Appl. Phys., vol. 38, No. 3, 1967, pp. 1001–1002.

Liu, J.F., et al., "Rare Earth Permanent Magnets for High Temperature Applications" Proceedings of the Fifteenth International Workshop on Rare–Earth Magnets and their Applications, Aug. 30–Sep. 3, 1998, pp. 607–622.

Liu, Sam, et al., "Long–Term Aging of $Sm_2(Co,Fe,Cu,Zr)_{17}$ Permanent Magnets at 300 and 400° C." IEEE Trans. Magn., vol. 33, No. 5, Sep. 1997, pp. 3859–3861.

Liu, Sam, Hoffman, Eugene P., "Application–Oriented Characterization of $Sm_2(Co,Fe,Cu,Zr)_{27}$ Permanent Magnets" IEEE Trans. Magn., vol. 32, No. 5, Sep. 1996, pp. 5091–5093.

Chen, C.H., et al., "$Sm_2(Co,Fe,Cu,Zr)_{17}$ magnets for use at temperature ≧400 ° C." J. Appl. Phys., vol. 83, No. 11, Jun. 1, 1998, pp. 6706–6708.

Walmer, M.S. et al., "Use of heavy rare earth element Gd in $RECo_3$ and $RE_2$ $TM_{17}$ magnets for high temperature applications" Proc. 15th Int. Workshop on Rare Earth Magnets and Their Applications, vol. 2, 1998, pp. 689–699.

MA, B.M. et al., "The Effect of Fe Content on the Temperature Dependent Magnetic Properties of $Sm(Co,Fe,CU,Zr)_2$ and $SmCo_5$ Sintered Magnets at 450° C." IEEE Trans. Magn., vol. 32, No. 5, Sep. 1996, pp. 4377–4379.

Kim, A.S., "High temperature stability of SmTM magnets" J. Appl. Phys., vol. 83, No. 11, 1998, pp. 6715–6717.

Benz., M.G.; Martin, D.L.., "Cobalt–Samarium Permanent Magnets Prepared by Liquid Phase Sintering" Appl. Phys. Letters, vol. 17, No. 4, 1970, pp. 176–177.

Ray, A.E. and Liu, S., "Recent Progress in 2:17 Type Permanent Magnets" J. Material Engineering and Performance, 1, 183–192, (1992).

Walmer, Marlin S., "A comparison of temperature compensation in $SmCo_5$ and $RE_2TM_{17}$ as measured in a permeameter, a traveling wave tube and an inertial device over the temperature range of –60° C. to 200° C." Proceedings of the 9th International Workshop on Rare Earth Magnets and their Applications, Bad Soden, Germany, 1987, pp. 131–140.

Kim, Andrews S., "Design of high temperature permanent magnets" J. Appl. Phys., vol. 81, No. 8, Apr. 15, 1997, pp. 5609–5611.

Ojima T. et al., "Magnetic Properties of a New Type of Rare–Earth Cobalt Magnets $Sm_2(Co, Cu, Fe, M)_{17}$" IEEE Trans. Magn., vol. MAG–13, No. 5, Sep. 1977, pp. 1317–1319.

Ray, Alden E., Strnat Karl J., "Easy Directions of Magnetization in Ternary $R_2(Co,Fe)_{17}$ Phases" IEEE Trans. Magn., vol. MAG–8, No. 3, Sep. 1972, pp. 516–518.

Tawara, Yoshio, Simat, Karl, "Rare Earth–Cobalt Permanent Magnets Near the 2–17 Composition" IEEE Trans. Magn., vol. MAG–12, No. 6, Nov. 1976, pp. 954–958.

Holler, G. Strnat, K., "Magnetocrystalline Anisotropy of $YCo_5$ and $Y_2Co_{17}$" IEEE Trans. Magn., vol. MAG–2, No. 3, Sep. 1967, pp. 487–489.

* cited by examiner

Extrinsic demagnetization curves for prior art Sm-TM magnet

Recoil process for a magnet with nonlinear extrinsic demagnetization curve

Recoil process for a magnet with a linear curve

Extrinsic demagnetization curves at $T_M$ for three samples of this invention

Comparison of demagnetization curves for a magnet with $T_M$ of 500°C and a prior art high temperature magnet with $T_M$ of 330°C. Magnets were cycled in a magnetic field between 0 and $H_C$ of the magnets Comparison of dynamic $(BH)_{max}$ at 400°C for a conventional magnet (B) and Example 2 of this invention Intrinsic and extrinsic demagnetization curves for Sample 2 ($T_M$ = 500°C)

Intrinsic and extrinsic demagnetization curves at 300°C to 550°C for Sample 3 ($T_M$ = 550°C)

Magnetic irreversible losses after exposure to the temperature for examples 1-3 of this invention compared to conventional magnets A and B Long-term thermal stability test results for 500°C exposure for Sample 2 compared to two conventional magnets Temperature coefficients of intrinsic coercivity versus temperature for Nd-Fe-B, conventional 2:17 and samples 5-7 of this invention

HIGH TEMPERATURE PERMANENT MAGNETS

CROSS REFERENCE TO RELATED APPLICATIONS

This application is a continuation of U.S. patent application Ser. No. 09/476,664, filed Jan. 3, 2000, now U.S. Pat. No. 6,451,132, which in turn claims the benefit of U.S. provisional application Serial No. 60/114,993 filed Jan. 6, 1999.

GOVERNMENT RIGHTS

The government has rights in this invention pursuant to Contract No. F33615-94-C-2418 awarded by the U.S. Air Force.

BACKGROUND OF THE INVENTION

The present invention relates to high temperature permanent magnet materials, and more particularly to permanent magnets which have improved magnetic properties at a desired operating temperature.

Permanent magnets containing one or more rare earth elements and transition elements are well known for use in a variety of applications. For example, magnets have been used in motors and generators for aircraft and spacecraft systems. Magnets have also been widely used in actuators, inductors, inverters, magnetic bearings, and regulators for flight control surfaces and other aircraft components. These applications require the magnets to operate at temperatures up to about 300° C.

In recent years, the need has increased for magnetic and electromagnetic materials capable of reliable operation at higher temperatures of from 300° C. to 600° C. For example, the MEA (More Electric Aircraft) initiative has stimulated the development of an Integrated Power Unit (IPU) which utilizes a high-speed, direct-coupled starter/generator and magnetic bearings integrated onto the rotor of a single-shaft gas turbine aircraft engine which permits direct coupling to the turbine shaft, thereby eliminating all gearing and lubrication found in current military and commercial aircraft power units. However, the operating temperature of magnetic materials for such an application is higher than 400° C. Other high temperature applications include replacement of hydraulic-mechanical components in aircraft with permanent magnets. Accordingly, magnetic materials capable of operating at temperatures as high as 400° C. and above are needed for such applications.

Currently, $Sm(Co_wFe_vCu_xZr_y)_z$ or $RE_2TM_{17}$ (where RE represents rare earth metals and TM represents transition metals) permanent magnet materials have been demonstrated as the best magnets for elevated temperature applications. These magnets have satisfied many applications at temperatures up to 300° C. However, such magnets have typically been unable to retain their magnetic properties at elevated temperatures greater than 300° C. For example, the intrinsic coercivity ($_iH_c$) of such magnets has been found to drop substantially at temperatures of 300° C. or greater. More importantly, the extrinsic demagnetization curve for such magnets is not straight, and linear extrinsic demagnetization curves are imperative for dynamic applications. In order to maintain stability at high temperatures, magnets must maintain a high $_iH_c$ and a low temperature coefficient of $_iH_c$ as well as a linear extrinsic demagnetization curve.

Accordingly, there is still a need in the art for a permanent magnet material which is capable of operating at temperatures higher than 300° C., which exhibits a high $_iH_c$ and a low temperature coefficient of $_iH_c$, and which exhibits a linear extrinsic demagnetization curve at high temperatures.

As additional background information, the early development of rare earth magnet alloy systems is discussed in the following papers:

- K. Strnat and W. Ostertag, "Program for an in-house investigation of the yttrium-cobalt alloy system", Technical Memorandum, May 64-4, Projects 7367 and 7360, AFML, Wright-Patterson AFB, Ohio, March, (1964)
- K. Strnat and G. Hoffer, "$YCo_5$—A promising New Permanent Magnet Material", USAF Tech. Doc. Rept., Materials Laboratory, WPAFB AFML-TR-65-446, May (1966).
- G. Hoffer and K. Strnat, "Magnetiocrystalline Anisotropy of $YCO_5$ and $Y2Co_{17}$", IEEE Trans. Magn., Mag-2, 487, September (1966).
- K. Strnat, G. Hoff, J. Olson, W. Ostertag, and J. Becker, "A family of new cobalt-base permanent magnet metarial", J. Appl. Phys. 38 1001, (1967)
- D. Das, "Twenty million energy product samarium-cobalt magnet", IEEE Trans., Magn. Mag-5, 214, (1969)
- M. Benz and D. Martin, "Cobalt-samarium permanent magnets prepared by liquid phase sintering", Appl. Phys. Lett., 17 176 (1970)

$RE_2TM_{17}$ type magnets were initiated from the investigation of $R_2(Co, Fe)_{17}$ alloy by A. E. Ray and K. J. Strnat in 1972. However, numerous attempts to develop high $_iH_c$ in these stoichiometric 2:17 alloys were generally unsuccessful and attention was then focused on $Sm(Co_{0.85}Cu_{0.15})_{68}$ (Nagel et al., 1975) and $Sm(Co_{0.85}Fe_{0.05}Cu_{0.10})_8$ (Tawara et al., 1976) with Br=10–11 kG, $H_c$=4–6 kOe, and $(BH)_{max}$=26 MGOe. $Sm(Co_{68}Fe_{0.28}Cu_{0.1}Zr_{0.01})_{7.4}$ with 30 MGOe was achieved in 1977 (Ojima et al., 1977). Research and development in the 1970's resulted in $RE_2TM_{17}$ type magnets with high energy product, where RE represents rare earth metals, such as Sm, Pr, Gd, Ho, Er, Ce, Y, Nd, and TM represents transition metals such as: Co, Fe, Cu, Zr, Hf, Ti, Mn, Nb, Mo, W, and other transition metals. Particularly preferred high performance magnets for the applications noted above are RE=Sm, Gd, Dy and TM=Co, Fe, Cu, and Zr, having the crystal structure of $Sm_2Co_{17}$. Most RE-TM magnets can be used at 250° C., and some of these magnets can perform well up to 330° C.

Some of these magnets are described in U.S. Pat. Nos. 4,210,471; 4,213,803; 4,284,440; 4,289,549; 4,497,672; 4,536,233; 4,565,587, 4,746,378, and 5,781,843. See also U.S. Pat. Nos. 3,748,193, 3,947,295; 3,970,484; 3,977,917; 4,172,717; 4,211,585; 4,221,613; 4,375,996; 4,382,061 and 4,578,125.

Publications relating to $RE_2TM_{17}$ type magnets are listed below:

- A. E. Ray and K. J. Strnat, IEEE Trans. Magn., Mag-8, 518, 1972
- Nagel, Perry and Menth, IEEE Trans. Magn. Mag-11, 1423, 1975
- Tawara and Strnat, "Rare earth Cobalt permanent magnets near the 2:17 composition", IEEE Trans. Magn. Mag-12, 954, 1976
- Ojima, Tomizawa, Yoneyama, and Hori, "Magnetic properties of a new type of rare earth magnets $Sm_2(Co,Cu,Fe,M)_{17}$, IEEE Trans. Magn. Mag-13, 1317, 1977
- A. E. Ray, "The development of high energy product permanent magnets from 2:17 RE-TM alloys", IEEE Trans, Mag-20, 1615, (1984)

Marlin S. Walmer, "A comparison of temperature compensation in $SmCo_5$ and $RE_2TM_{17}$ as measured in a permeameter, a traveling wave tube and an inertial device over the temperature range of −60° to 200° C.", Proceedings of the $9^{th}$ International workshop on rare earth magnets and their applications, Bad Soden, Germany, 131–140 (1987)

H. F. Mildrum and K. D. Wong, "Stability and temperature cycling behavior of RE-Co magnets", Proceedings of the $9^{th}$ International workshop on rare earth magnets and their applications, Bad Soden, Germany, 35–54 (1987)

J. Fidler, et al., "Analytical Electron microscope study of high and low coercivity SmCo 2:17 magnets", Mat. Res. Sol. Sym. Proc. 96, 1987

Popov et al., "Inference of copper concentration on the magnetic properties and structure of alloys", Phys. Met. Metall., 60 (2), 18–27, (1990)

A. E. Ray and S. Liu, "Recent progress in 2:17 type permanent magnets", J. Material Engineering and Performance, 1, 183–192, (1992)

Extrinsic demagnetization curves for prior art Sm-TM magnet materials are set forth in FIG. 1 which shows that linear extrinsic demagnetization curves existed up to about 330° C. The curves become non-linear above 330° C.

FIG. 2 illustrates the recoil process for a magnet with a nonlinear extrinsic demagnetization curve, when the demagnetization force drives the magnet past the "knee" of the curve and back to zero magnetic strength.

Further work has been done on RE-TM magnets for use at temperatures above 300° C. References related to these high temperature RE-TM magnets are listed below:

Marlin S. Walmer and Michael H. Walmer, "Knee formation of high Co content 2:17 magnets for MMC high temperature applications", EEC internal report, May, 1995

S. Liu and E. P. Hoffman, "Application-oriented characterization of $Sm_2(Co,Fe,Cu,Zr)_{17}$ permanent magnets," IEEE Trans. Magn., 32, 5091, (1996).

B. M. Ma, Y. L. Liang, J. Patel, D. Scott, and C. O. Bounds, "The effect of Fe content on the temperature dependent magnetic properties of Sm(Co,Fe,Cu,Zr)z and $SmCo_5$ sintered magnets at 450° C.," IEEE Trans. Magn., 32, 4377 (1996).

S. Liu, G. P. Hoffman, and J. R. Brown, "Long-term aging of $Sm_2(Co,Fe,Cu,Zr)_{17}$ permanent magnets at 300 and 400° C.," IEEE Trans. Magn., 33, 3859 (1997) A. S. Kim, J. Appl. Phys. 81, 5609 (1997).

C. H. Chen, M. S. Walmer, M. H. Walmer, S. Liu, E. Kuhl, G. Simon, "$Sm_2(Co,Fe,Cu,Zr)_{17}$ magnets for use at temperature[3] 400° C.", J. Appl Phys. 83 (11), 6706 (1998)

A. S. Kim, "High temperature stability of SmTM magnets," J. Appl. Phys., 83 (11), 6715 (1998)

M. S. Walmer, C. H. Chen, M. H. Walmer, S. Liu, G. E. Kuhl, G. K. Simon, "Use of heavy rare earth element Gd in $RECo_5$ and $RE_2TM_{17}$ magnets for high temperature applications", Proc. $15^{th}$ Int. Workshop on Rare Earth Permanent Magnets and Their Applications, p. 689, (1998)

A. S. Kim, U.S. Pat. No. : 5,772,796 (1998)

J. F. Liu, Y. Zhang, Y. Ding, D. Dimitar, F. Zhang, and G. C. Hadjipanayis, "Rare earth permanent magnets for high temperature applications", Proc. $15^{th}$ Int. Workshop on Rare Earth Permanent Magnets and Their Applications, p. 607, (1998)

Christina H. Chen, Marlin S. Walmer, Michael H. Walmer, Wei Gong, and Bao-Min Ma, "The relationship of thermal expansion to magnetocrystalline anisotropy, spontaneous magnetization and $T_c$ for permanent magnets", J. Appl. Phys., 85(8), 5669 (1999)

J. F. Liu, Y. Zhang, D. Dimitar, and G. C. Hadjipanayis, "Microstructure and high temperature magnetic properties of $Sm(Co,Cu,Fe,Zr)_z$ (z=6.7–9.1) permanent magnets", J. Appl. Phys. 85(5), 2800 (1999)

Sam Liu, Jie Yang, Gerorge Doyle, G. Edward Kuhl, Christina Chen, Marlin Walmer, Michael Walmer, and Gerard Simon, "New sintered high temperature Sm-Co based permanent magnet materials", IEEE Trans. Magn. 35, 3325 (1999)

Sam Liu and G. Edward Kuhl, "Temperature coefficients of Rare earth permanent magnets", IEEE Trans. Magn. 35, 3371 (1999)

Christina H. Chen, Marlin S. Walmer, Michael H. Walmer, Sam. Liu, E. Kuhl, Geared K. Simon, "New Sm-TM magnetic materials for application up to 550° C.", 1999 Spring meeting, MRS Symposia Proceedings, to be published, (1999).

Christina H. Chen, Marlin S. Walmer, Michael H. Walmer, Jinfang Liu, Sam Liu, E. G. Kuhl, "Magnetic pinning strength for the new Sm-TM magnetic materials for use up to 550° C.", $44^{th}$ MMM conference in 1999, to be published in J. Appl. Phys., April, (2000)

Sam Liu, Jie Yang, George Doyle, Gregory Potts, and G. Edward Kuhl C. H. Chen, M. S. Walmer, M. H. Walmer, "Abnormal temperature dependence of intrinsic coercivity in sintered Sm-Co based permanent magnets", $44^{th}$ MMM conference in 1999, to be published in J. Appl. Phys., April, (2000)

Marlin S. Walmer, Christina H. Chen, Michael H. Walmer, Sam Liu, E. G. Kuhl, "Thermal stability at 300–550° C. for a new series of $Sm_2TM_{17}$ materials with maximum use temperature up to 550° C.", Intermag 2000, to be published in IEEE Trans. Mag. (2000)

Sam Liu, Gregory Potts, George Doyle, Jie Yang, and G. Edward Kuhl, C. H. Chen, M. S. Walmer, M. H. Walmer, "Effect of z value on igh temperature performance of $Sm(Co,Fe,Cu,Zr)_z$ with z=6.5–7.3", Intermag 2000, to be published in IEEE Trans. Mag. (2000)

SUMMARY OF THE INVENTION

The present invention provides a new class of permanent magnets which have optimum magnetic properties at specific high operating temperatures. The permanent magnets show high resistance to thermal demagnetization and exhibit linear extrinsic demagnetization curves at elevated temperatures up to 700° C.

According to one aspect of the present invention, a permanent magnet is provided which is represented by the general formula $RE(Co_wFe_vCu_xT_y)_z$, where RE is a rare earth element selected from the group consisting of Sm, Gd, Pr, Nd, Dy, Ce, Ho, Er, La, Y, Tb, and mixtures thereof, and T is a transition metal selected from the group consisting of Zr, Hf, Ti, Mn, Cr, Nb, Mo, W, V, Ni, Ta, and mixtures thereof, wherein the magnet exhibits a substantially linear extrinsic demagnetization curve at a maximum operating temperature $T_M$ up to 700° C. "$T_M$" is defined in this invention as the maximum operating temperature where a linear extrinsic demagnetization curve can exist for the magnet. Preferably, the substantially linear extrinsic demagnetization curve has a slope between 1.00 and 1.25.

The permanent magnet preferably has a temperature coefficient β of intrinsic coercivity of between 0.30%/° C. and −0.30%° C. The permanent magnet also preferably has a temperature coefficient of residual induction $B_r$ of between +0.02%/° C. to −0.040%/° C.

The permanent magnet also has a small cellular structure, having a cell size of preferably ≦100 nm.

A preferred composition of the permanent magnet is one in which the effective z is between about 6.5 and about 8.0, w is between about 0.50 and about 0.85, v is between 0.0 and about 0.35, x is between about 0.05 and about 0.20, and y is between about 0.01 and about 0.05. In one preferred embodiment, the permanent magnet comprises from between about 22.5% and about 35.0% by weight effective Sm (samarium), between about 42% and about 65% by weight Co (cobalt), between 0.0% and about 25% by weight Fe (iron), between about 2.0% and about 17.0% by weight Cu (copper), and between about 1.0% and about 5.0% by weight Zr (zirconium). In another preferred embodiment, the magnet comprises from between about 23.5% and about 28.0% by weight effective Sm, from between about 50% and about 60% by weight Co, from between about 4.0% and about 16% by weight Fe, from between about 7.0% and about 12% by weight Cu, and from between about 2.0% and about 4.0% by weight T, where T is as defined above.

In another embodiment of the invention, the permanent magnet comprises about 24.7% by weight effective Sm, about 57.8% by weight Co, about 7.0% by weight Fe, about 7.1% by weight Cu, and about 3.4% by weight of a mixture of Zr and Nb. In yet another embodiment, the permanent magnet comprises about 26% by weight effective Sm, about 59.5% by weight Co, about 3.3% by weight Fe, about 7.6% by weight Cu, and about 3.6% by weight of a mixture of Zr and Nb. In yet another embodiment, the magnet preferably comprises about 26% by weight effective Sm, about 61.0% by weight Co, about 1.0% by weight Fe, about 8.2% by weight Cu, and about 3.8% by weight of a mixture of Zr and Nb.

In another alternative embodiment of the invention, a permanent magnet is provided having the general formula $RE(Co_wFe_vCu_xT_y)_z$ is provided, where RE is a rare earth element selected from the group consisting of Sm, Gd, Pr, Nd, Dy, Ce, Ho, Er, La, Y, Tb, and mixtures thereof, T is a transition metal selected from the group consisting of Zr, Hf, Ti, Mn, Cr, Nb, Mo, W, V, Ni, Ta, and mixtures thereof, the sum of w, v, x and y is 1; and z has a value between about 6.5 and 8.0.

The permanent magnet of the present invention is preferably prepared by increasing the cobalt content as the operating temperature increases. The cobalt content (w) of the magnet is preferably determined by the formula $w=0.5332+0.0004935\cdot T_M$. The magnet may be prepared so as to have a maximum operating temperature $T_M$ of between about 340° C. to about 700° C.

Accordingly, it is a feature of the present invention to provide a permanent magnet which retains its magnetic properties and exhibits a linear extrinsic demagnetization curve at operating temperatures up to 700° C. Other features and advantages of the invention will be apparent from the following description, the accompanying drawings, and the appended claims.

DETAILED DESCRIPTION OF THE PREFERRED EMBODIMENT

Figure 1:
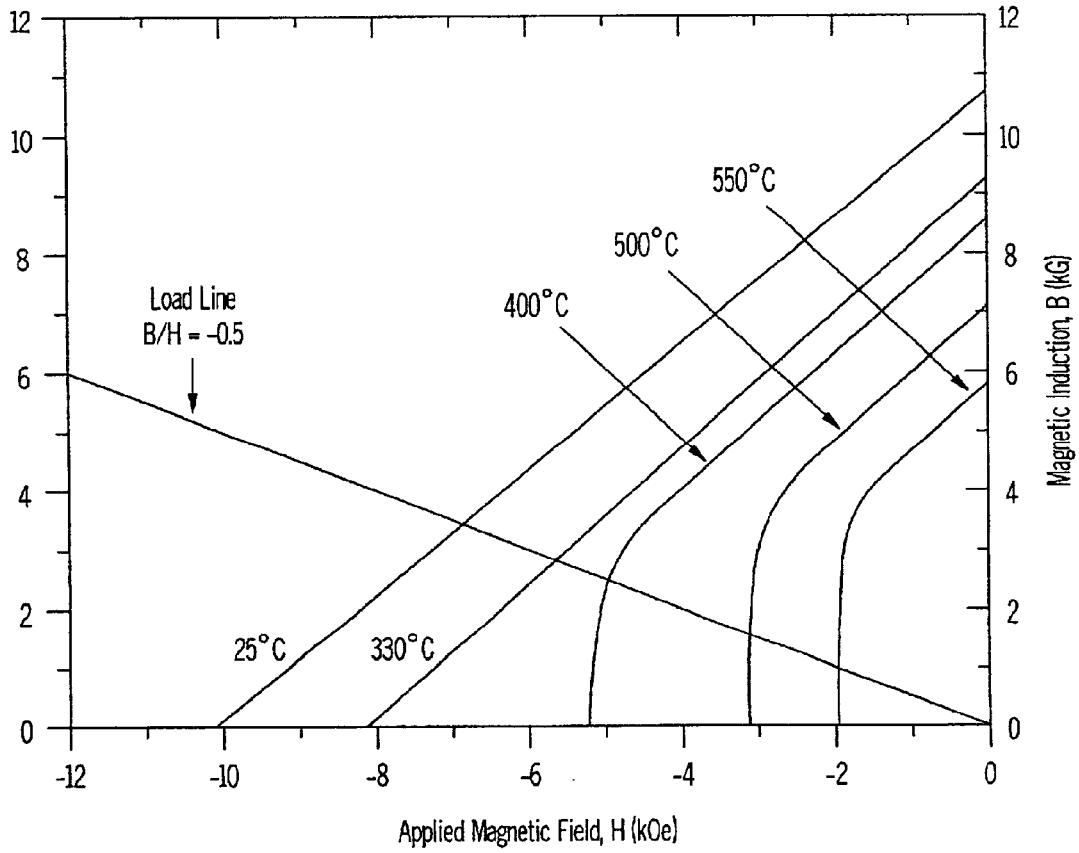
FIG. 1 is a graph illustrating extrinsic demagnetization curves for prior art Sm-TM magnet materials with linear curves existing up to 330° C. and with nonlinear curves above this operating temperature.

The present invention provides a new class of permanent RE-TM magnets with high resistance to thermal demagnetization for high temperature applications, where substantially linear extrinsic demagnetization curves are maintained at maximum operating temperatures $T_M$ of up to 700° C.

The magnets of the present invention have the crystal structure $Sm_2Co_{17}$ and typical 2:17 cellular and lamella microstructure with a smaller cell size (≦100 nm) than conventional 2:17 magnets to provide strong pinning force to resist thermal demagnetization.

The magnets of the present invention are based on critically combined contents of Co, Fe, Cu and other elements in the magnets to achieve the maximum magnetic properties, i.e., high Curie temperatures $T_c$ up to 930° C., high energy product $(BH)_{max}$ at temperatures above 400° C., low temperature coefficients β of ${}_iH_c$ and high ${}_iH_c$ at high temperatures and low irreversible losses of magnetic strength after exposure to high temperatures. We have found that generally, these properties can be obtained by producing magnets having high Co contents, low Fe contents, and high Cu contents.

Conventional commercial Sm-TM 2:17 type magnets generally have a large negative temperature coefficient of intrinsic coercivity, i.e., about −0.36%/° C. at about 25° C. However, by adjusting the composition of the Sm-TM magnets within the preferred ranges, magnets having a small negative or even positive temperature coefficient of intrinsic coercivity can be achieved. The magnets of the present invention preferably have a temperature coefficient of intrinsic coercivity of between 0.30%/° C. and −0.30%/° C.

In addition, we have found that for each desired operating temperature $T_M$, there is a discrete Co content for the magnet. The relationship of Co content (w) and the operating temperature $T_M$ can be expressed by the following formula:

$$w=0.5332+0.0004935\cdot T_M$$

This formula makes it possible to determine the amount of Co needed for a desired operating temperature to produce a magnet which exhibits the highest possible $(BH)_{max}$ and which exhibits a linear extrinsic demagnetization curve for each high temperature application. The permanent magnet of the present invention is represented by the general formula $RE(TM)_z$ or $RE(Co_wFe_vCu_xT_y)_z$, where RE is a rare earth element selected from Sm, Gd, Pr, Nd, Dy, Ce, Ho, Er, La, Y, Tb, and mixtures thereof. T is a transition metal selected from Zr, Hf, Ti, Mn, Cr, Nb, Mo, W, V, Ni, Ta, and mixtures thereof. It should be appreciated that certain RE metals like Sm have a great affinity for oxygen and form $Sm_2O_3$ whenever oxygen is available. Every 0.10 wt. % oxygen in the magnets will consume 0.626 wt. % Sm from the magnetic phase. Different manufacturing processes will result in different oxygen contents; therefore the use of effective Sm content is intended for this invention. For the purpose of this invention, effective Sm content is defined as total Sm minus any Sm in the form of $Sm_2O_3$.

The subscript z is the ratio of TM (transition metals) to effective RE as described above, which ratio is ≧5.0. Preferably, z is between about 6.5 and 8.0, w is between about 0.50 and about 0.85, v is between about 0.0 and about 0.35, x is between about 0.05 and about 0.20, and y is between about 0.01 and about 0.05.

In order that the invention may be more readily understood, reference is made to the following examples which are intended to illustrate the invention, but not limit the scope thereof.

EXAMPLE 1

A series of magnets were made according to the present invention using a powder metallurgy technique, and selected samples (1–8) were tested as described below. The compositions for samples 1–4 are listed in Table I. The alloys were melted and cast in a controlled atmosphere induction melting furnace, and then crushed into coarse powder with <200 μm particle size. Ball milling with liquids or jet milling with nitrogen gas was then used to reduce the particles into 2.5–8.0 μm to obtain single crystal powder. The liquids for ball milling included hexane, acetone, toluene, or other liquids to exclude formation of $Sm_2O_3$. The fine powders were then magnetically aligned and isostatically pressed. The pressed compacts were sintered at temperatures between 1180° C. and 1230° C. for 1–2 hours followed by solution heat treatment at 1160° C. to 1210° C. for 2 to 6 hours. It should be appreciated that the optimum sinter temperatures and solution heat treatment temperatures depend on the compositions. No single sinter temperature can suit the entire range of $Sm(Co_wFe_vCu_xT_y)_z$ magnets with $T_M$=400° C. to 700° C. (We have found that the higher the cobalt content, the higher optimum temperature for sinter and heat treatment). The sintered parts were then aged at 780° C. to 850° C. for 10 to 20 hours followed by slow cooling to 400° C. The cooling rate was about 1.5° C./min.

TABLE I

Chemical composition for Samples 1, 2, 3, and 4

| Sample | $T_M$ (° C.) | Co (w) | Fe (v) | Cu (x) | T(Zr ,Nb) (y) | z = TM/Sm* | $Sm_2O_3$, C and trace elements |
|---|---|---|---|---|---|---|---|
| 1 | 400 | 0.73 | 0.17 | 0.08 | 0.02 | 7.8 | Bal. |
| 2 | 500 | 0.78 | 0.10 | 0.09 | 0.03 | 7.7 | Bal. |
| 3 | 550 | 0.81 | 0.05 | 0.11 | 0.03 | 7.6 | Bal. |
| 4 | 600 | 0.83 | 0.01 | 0.13 | 0.04 | 7.5 | Bal. |

*Effective Sm = Total Sm minus any Sm in the form of $Sm_2O_3$.

The magnetic properties were tested using a KJS hysteresigraph for temperatures up to 300° C. and using a vibrating sample magnetometer (VSM) for temperatures ranging from 300° C. to 1000° C. Curie temperatures were determined with a VSM. Table II shows the magnetic properties at 25° C. to 600° C. for samples 1 and 2 in comparison with conventional magnets.

TABLE II

Magnetic properties at 25° C. to 600° C.

| | | 25° C. | | 300° C. | | 400° C. | | 500° C. | | 600° C. | |
|---|---|---|---|---|---|---|---|---|---|---|---|
| Sample | $T_M$ (° C.) | $_iH_c$ [kOe] | $(BH)_{max}$ [MGOe] | $_iH_c$ [kOc] | $(BH)_{max}$ [MGOe] | $_iH_c$ [kOe] | $(BH)_{max}$ [MGOe] | $_iH_c$ [kOe] | $(BH)_{max}$ [MGOe] | $_iH_c$ [kOe] | $(BH)_{max}$ [MGOe] |
| A* | 250 | 25 | 31.5 | 7.1 | 23.7 | 3.4 | 13.8 | 1.5 | 5.9 | 0.7 | 2.3 |
| B** | 330 | 33 | 27.5 | 11.6 | 21.0 | 5.4 | 16.7 | 2.9 | 8.7 | 1.2 | 3.5 |
| 1 | 400 | 34 | 24.6 | 14.6 | 18.8 | 8.8 | 16.5 | 4.7 | 12.5 | 2.1 | 5.6 |
| 2 | 500 | 29 | 20.8 | 16.7 | 15.6 | 12.4 | 13.2 | 7.3 | 10.4 | 3.6 | 6.8 |
| 3 | 550 | 25 | 16.4 | 17.0 | 12.0 | 13.2 | 9.9 | 8.8 | 7.6 | 4.7 | 5.2 |

*A is a commercial Sm-TM magnet with $T_M$ of 250° C.
**B is a prior art high temperature Sm-TM magnet with $T_M$ of 330° C.

The magnets of this invention with high $T_M$ have higher Curie temperature as shown in Table III. These magnets also have very small temperature coefficients, β, of $_iH_c$. Table III shows the temperature coefficient data. It is clear that magnets with higher $T_M$ have much smaller β than the previous best commercial materials.

TABLE III

| Sample | $T_M$ (° C.) | Co content (w) | $T_c$ (° C.) | β * for $_iH_c$ (25–300° C.) (%/° C.) | β * for $_iH_c$ (25–400° C.) (%/° C.) | β * for $_iH_c$ (25–500° C.) (%/° C.) |
|---|---|---|---|---|---|---|
| | | | $T_c$ and the temperature coefficient β of $_iH_c$ | | | |
| A# | 250 | 0.64 | 805 | −0.260 | −0.230 | −0.198 |
| B## | 330 | 0.68 | 815 | −0.236 | −0.223 | −0.192 |
| 1 | 400 | 0.73 | 850 | −0.207 | −0.198 | −0.181 |
| 2 | 500 | 0.78 | 850–925** | −0.154 | −0.153 | −0.157 |
| 3 | 550 | 0.81 | 850–925** | −0.116 | −0.128 | −0.136 |

#A is a commercial magnet with $T_M$ of 250° C.
B is a prior art high temperature Sm-TM magnet with $T_M$ of 330° C.
*β is an average temperature coefficient of $_iH_c$ at the temperature range.
**Two peaks appeared in the $T_c$ measurement curve.

Prior art Sm-TM type permanent magnets have linear extrinsic demagnetization curves at temperatures up to 330° C., as shown in FIG. 1. Above 330° C., the extrinsic demagnetization curves are nonlinear and characterized by a "knee".

Figure 2A:
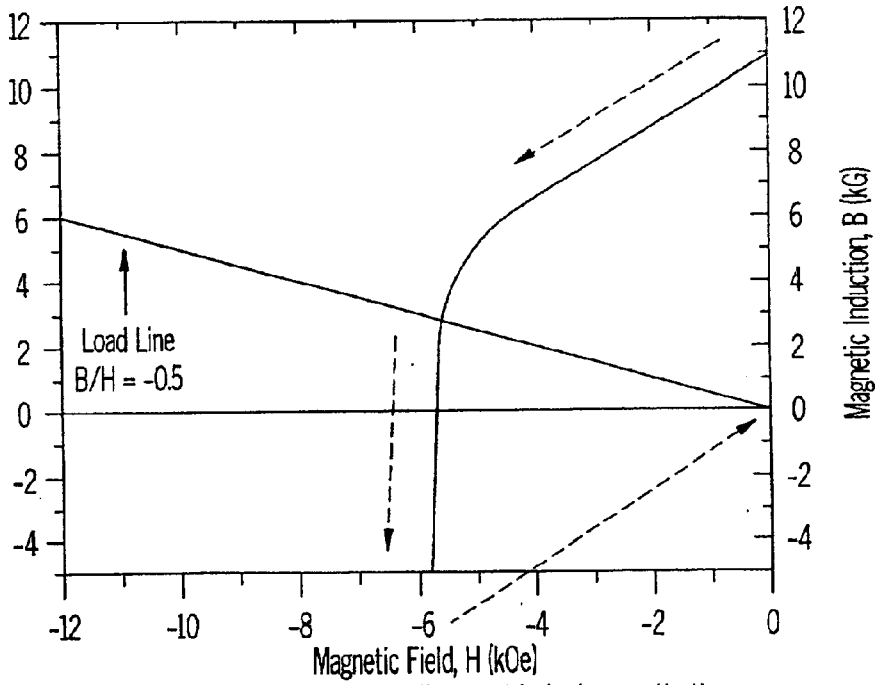
FIG. 2*a* is a graph illustrating a recoil process for a magnet with a nonlinear extrinsic demagnetization curve.
Figure 2B:
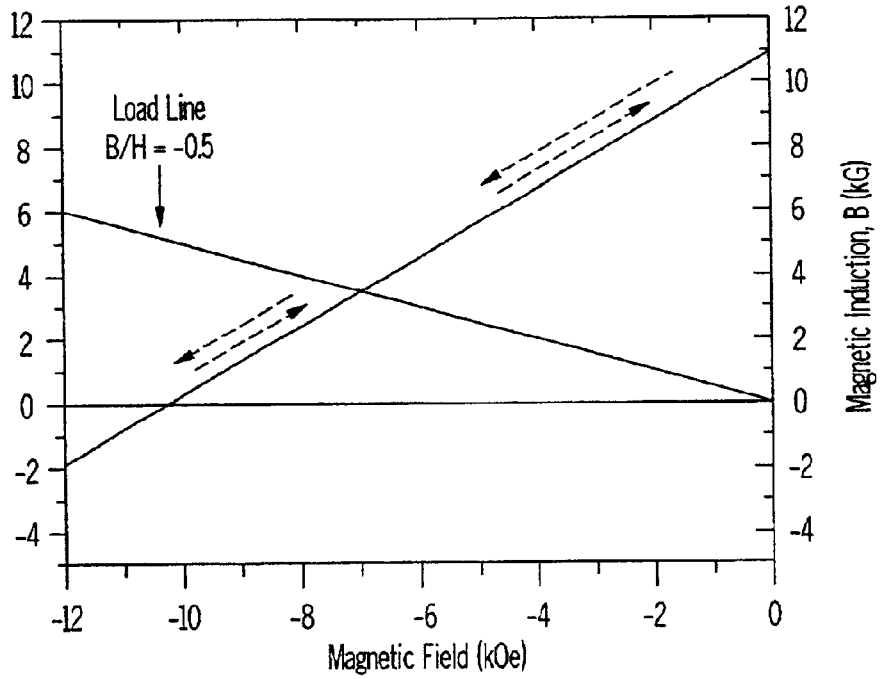
FIG. 2*b* is a graph illustrating a recoil process for a magnet with a linear curve.

The recoil process for permanent magnets with nonlinear, extrinsic demagnetization curves is shown in FIG. 2*a*. Demagnetization forces drive the magnet past the "knee" and back to zero magnetic induction. The recoil process for permanent magnets with linear extrinsic demagnetization curves is shown in FIG. 2*b*. Demagnetization forces drive the magnet to a lower induction level and back to the original magnetic induction.

Figure 3:
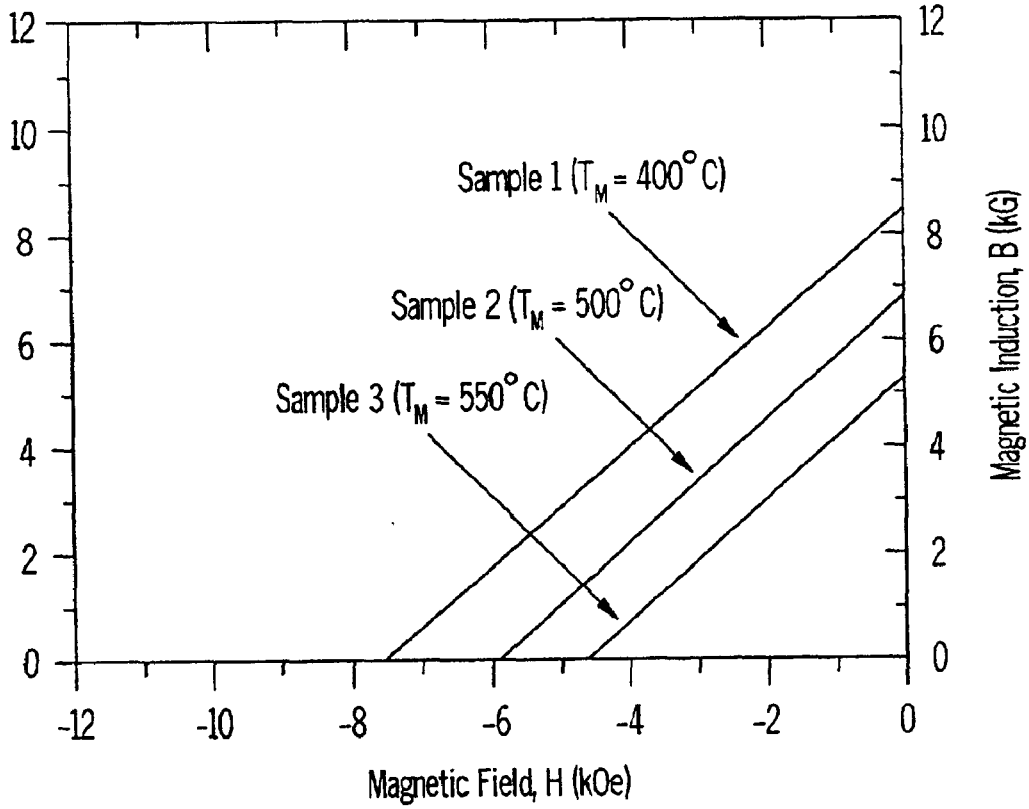
FIG. 3 is a graph illustrating extrinsic demagnetization curves at $T_M$ from 400° C. to 550° C. for magnets of the present invention.

FIG. 3 shows extrinsic demagnetization curves at temperatures of 400° C., 500° C. and 550° C. for samples 1 to 3 of magnets of the present invention described in Tables I, II, and III.

Figure 4:
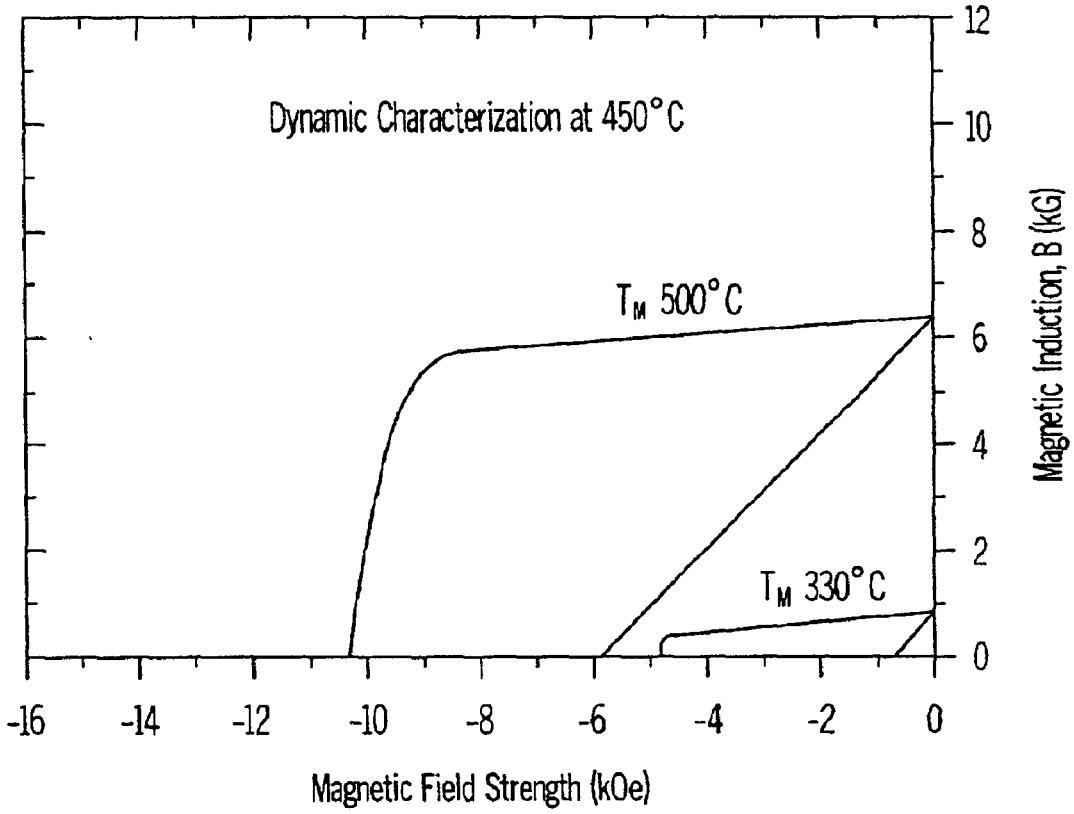
FIG. 4 is a graph illustrating a comparison of dynamic demagnetization curves at 450° C. for the prior art Sm-TM magnet versus a magnet of the present invention with a $T_M$ of 500° C.

FIG. 4 shows a comparison of demagnetization curves at 450° C. for the prior art Sm-TM magnet and the magnet of the present invention with $T_M$ of 500° C. (sample 2), where both magnets were cycled in magnetic fields between 0 and $H_c$.

Figure 5:
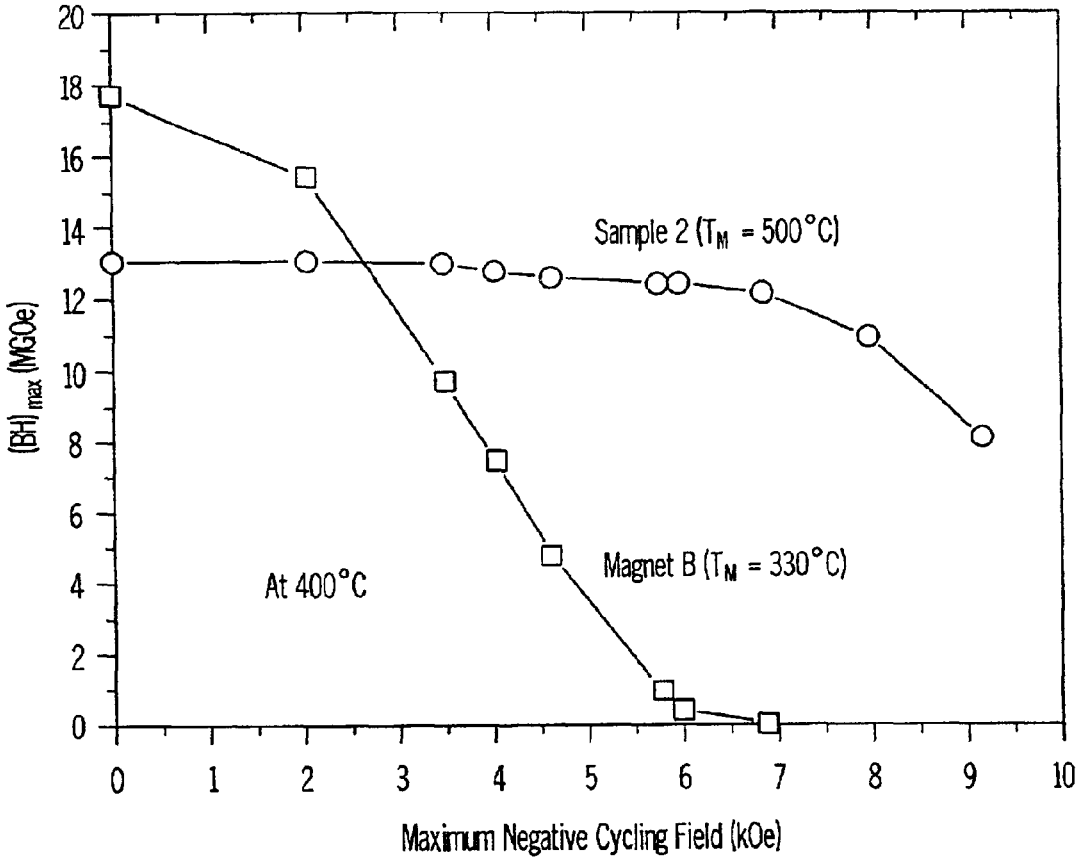
FIG. 5 is a graph illustrating a comparison of dynamic $(BH)_{max}$ at 400° C. for the previous best Sm-TM magnet and a magnet of the present invention with $T_M$ of 500° C.

FIG. 5 shows a dynamic comparison of $(BH)_{max}$ at 400° C. for a prior art Sm-TM magnet and a magnet of the present invention with $T_M$ of 500° C. (sample 2).

Figure 6:
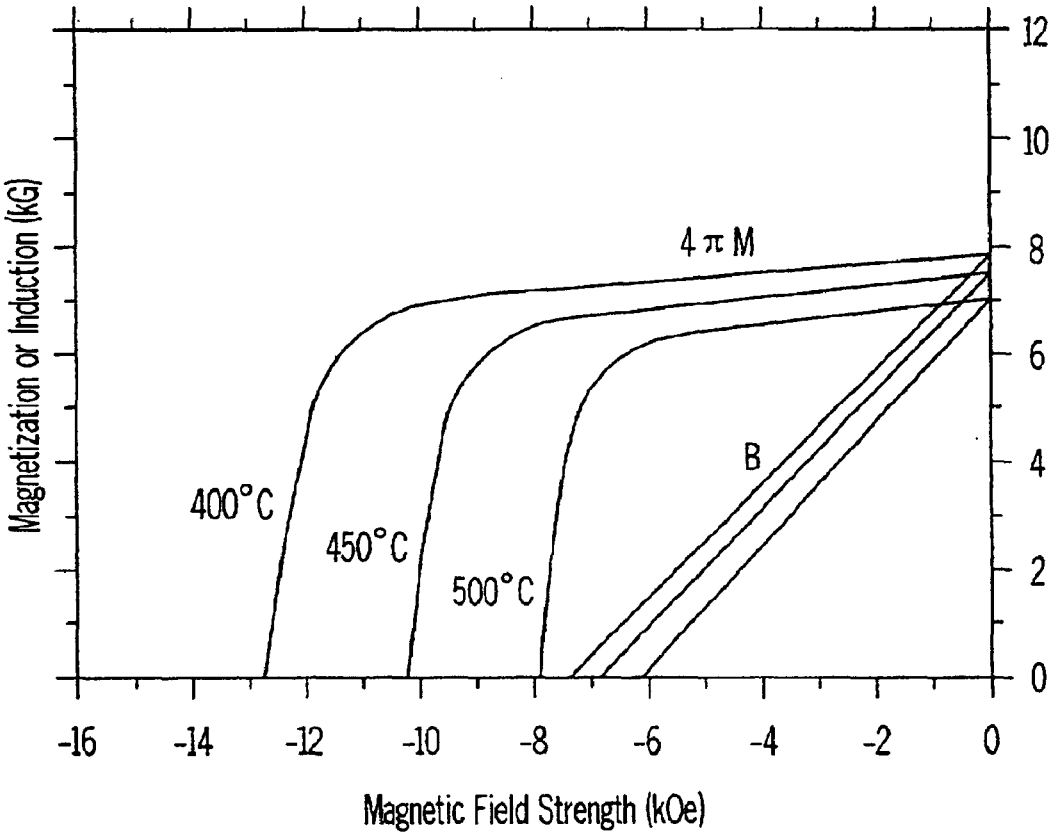
FIG. 6 is a graph illustrating intrinsic and extrinsic demagnetization curves for use temperatures ranging from 400° C. to 500° C. for a magnet of the present invention having a $T_M$ of 500° C.
Figure 7:
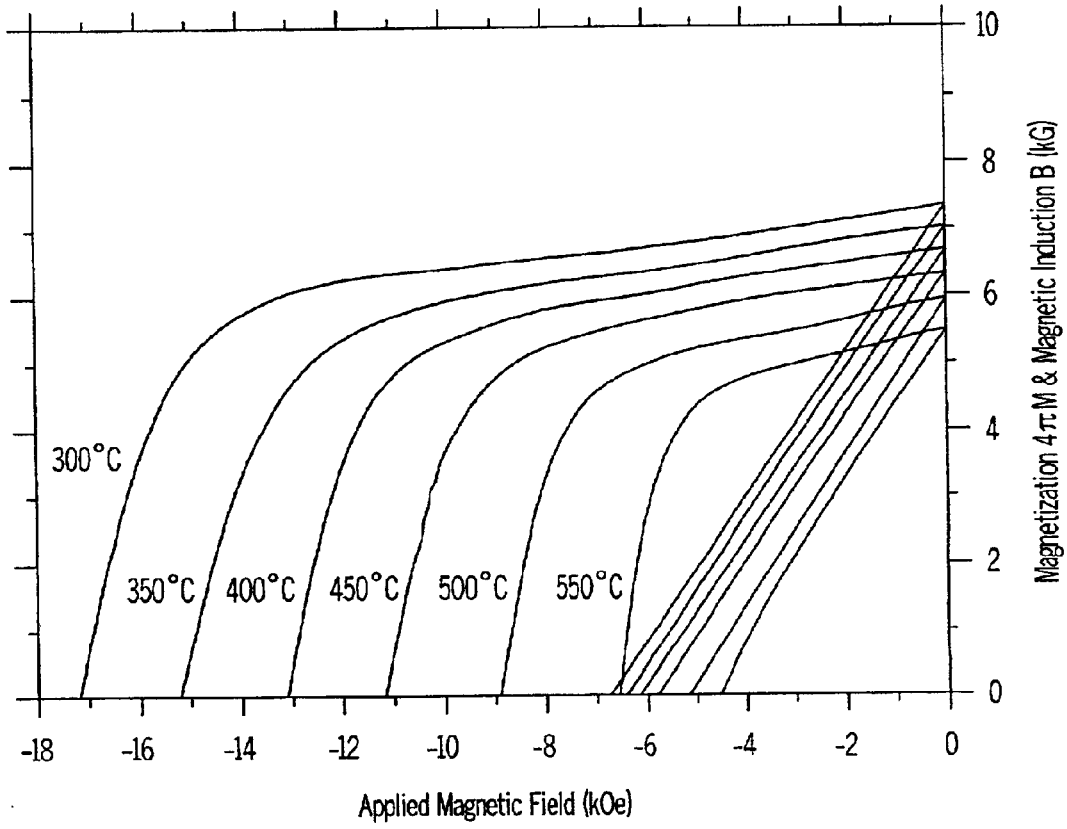
FIG. 7 is a graph illustrating intrinsic and extrinsic demagnetization curves at temperatures up to 550° C. for a magnet of the present invention.

Intrinsic and extrinsic demagnetization curves at various temperatures for samples 1 and 2 are shown in FIG. 6 and FIG. 7. As can be seen, the intrinsic coercivity $_iH_c$ is decreased slowly while the temperature increased. All the extrinsic demagnetization curves are substantially linear.

Figure 8A:
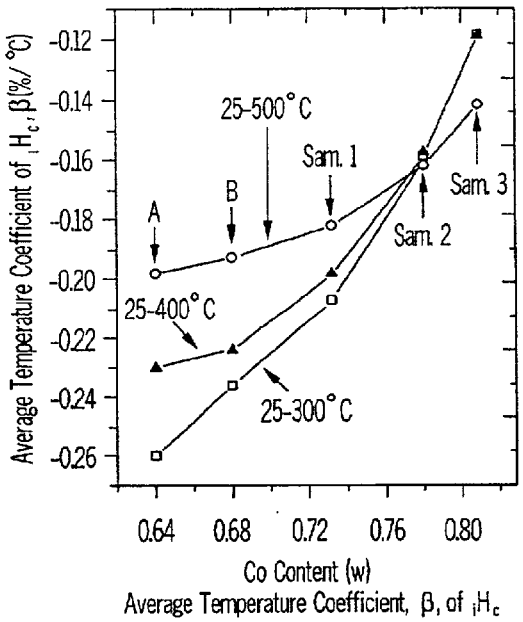
FIGS. 8*a* through 8*d* are graphs illustrating the magnetic properties vs. Co content of various magnets of the present invention.
Figure 8B:
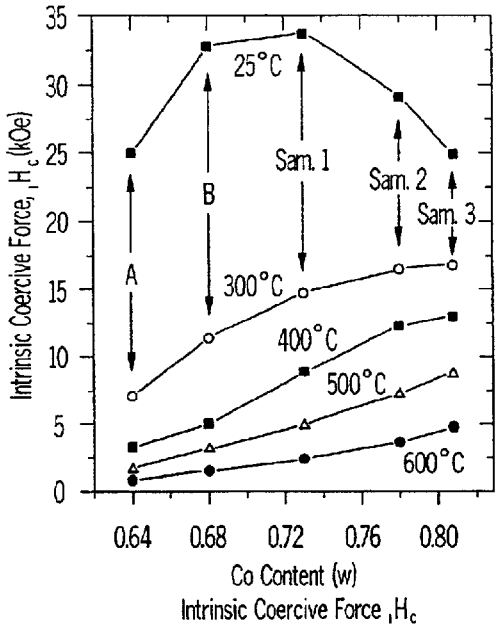
Figure 8C:
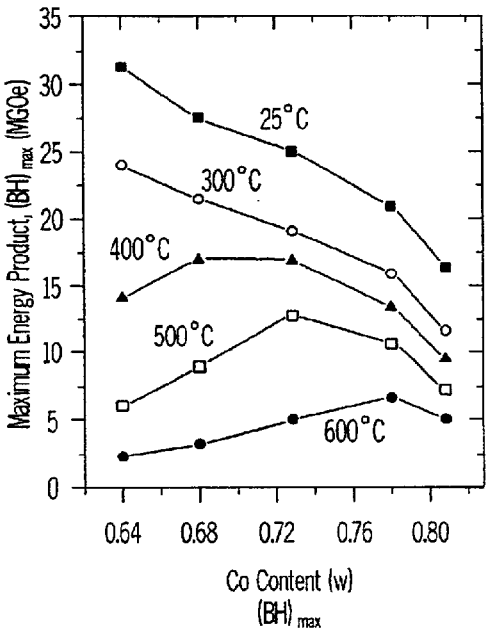
Figure 8D:
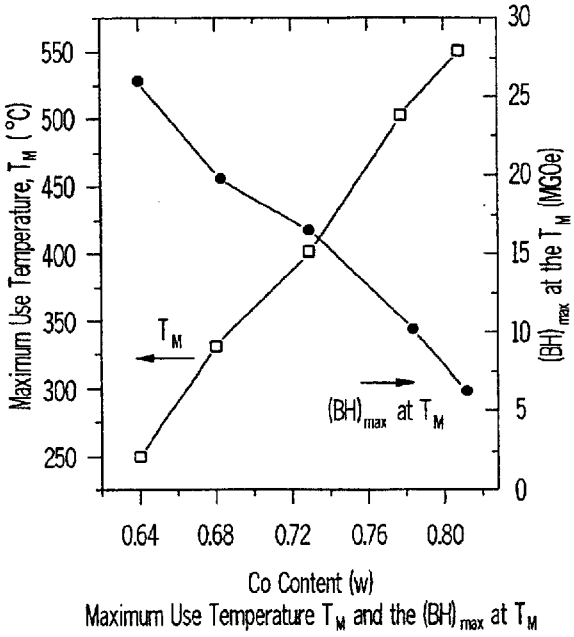

The magnetic properties vs. Co content for magnets of the present invention are plotted in FIG. 8*a* through FIG. 8*d*. FIG. 8*a* exhibits the dependence of temperature coefficient of $_IH_C$ on Co content w. The average temperature coefficient β of $_iH_c$ at 25° C. to 300° C. is decreased from β=−0.260%/° C. for w=0.64 to β=−0.116%/° C. for w=0.81. The β is decreased by 55% when w is increased by 27%. FIG. 8*b* shows the $_iH_c$ vs. Co content w at 25° C., 300° C., 400° C., 500° C. and 600° C. Regardless of what $_iH_c$ is at room temperature, the $_iH_c$ is dependent on Co content w at temperatures above 300° C.: the higher the Co content, the higher the $_iH_c$ at T>300° C. FIG. 8*c* shows the $(BH)_{max}$ vs. the Co content at different temperatures. At room temperature, $(BH)_{max}$ is decreased as the Co content is increased. This is due to the fact that Co has lower saturation magnetization, Ms, than that for Fe. When the temperature is increased, magnets with higher Co have lower β, higher $T_c$, and lower thermal losses. At 25° C., the highest $(BH)_{max}$ is obtained with w=0.64. At 500° C., the highest $(BH)_{max}$ is obtained with w=0.73. At 600° C., the highest $(BH)_{max}$ is obtained with w=0.78. Clearly, only those magnets with w>0.82 will survive at even higher temperatures. FIG. 8*d* shows the $(BH)_{max}$ at $T_M$ and the $(BH)_{max}$ at the temperature $T_M$ for each Co content. The significance is that the magnets with higher $T_M$ have a linear extrinsic demagnetization curve at $T_M$, which makes the magnets thermally stable in high temperature applications.

Figure 9:
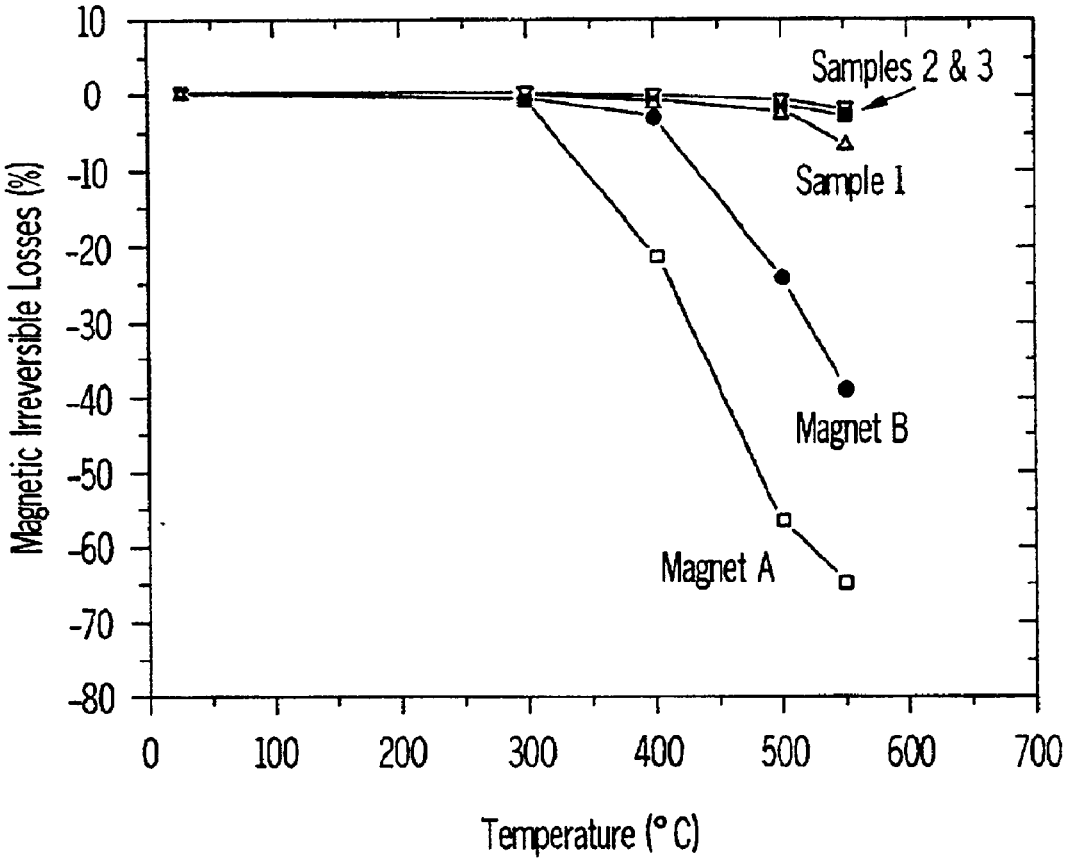
FIG. 9 is a graph illustrating the irreversible losses vs. temperature for magnets of the present invention in comparison to two conventional magnets.

Table IV shows the irreversible losses of magnetic flux for the magnets of this invention compared with conventional Sm-TM magnets. These irreversible losses are also shown in FIG. 9.

TABLE IV

| Sample | $T_M$ (° C.) | Irreversible loss (%) 300° C. | 400° C. | 500° C. | 550° C. |
|---|---|---|---|---|---|
| | | Irreversible losses of magnetic flux after exposure to elevated temperatures | | | |
| A* | 250 | 1.1 | 22.1 | 57.7 | 66.0 |
| B** | 330 | 1.1 | 3.5 | 25.1 | 39.9 |
| 1 | 400 | 0.6 | 1.6 | 3.3 | 7.2 |
| 2 | 500 | 0.6 | 1.0 | 2.1 | 3.3 |
| 3 | 550 | 0.6 | 0.7 | 1.7 | 2.7 |

*A is a commercial magnet with $T_M$ of 250° C.
**B is prior art high temperature Sm-TM magnet with $T_M$ of 330° C.

Figure 10:
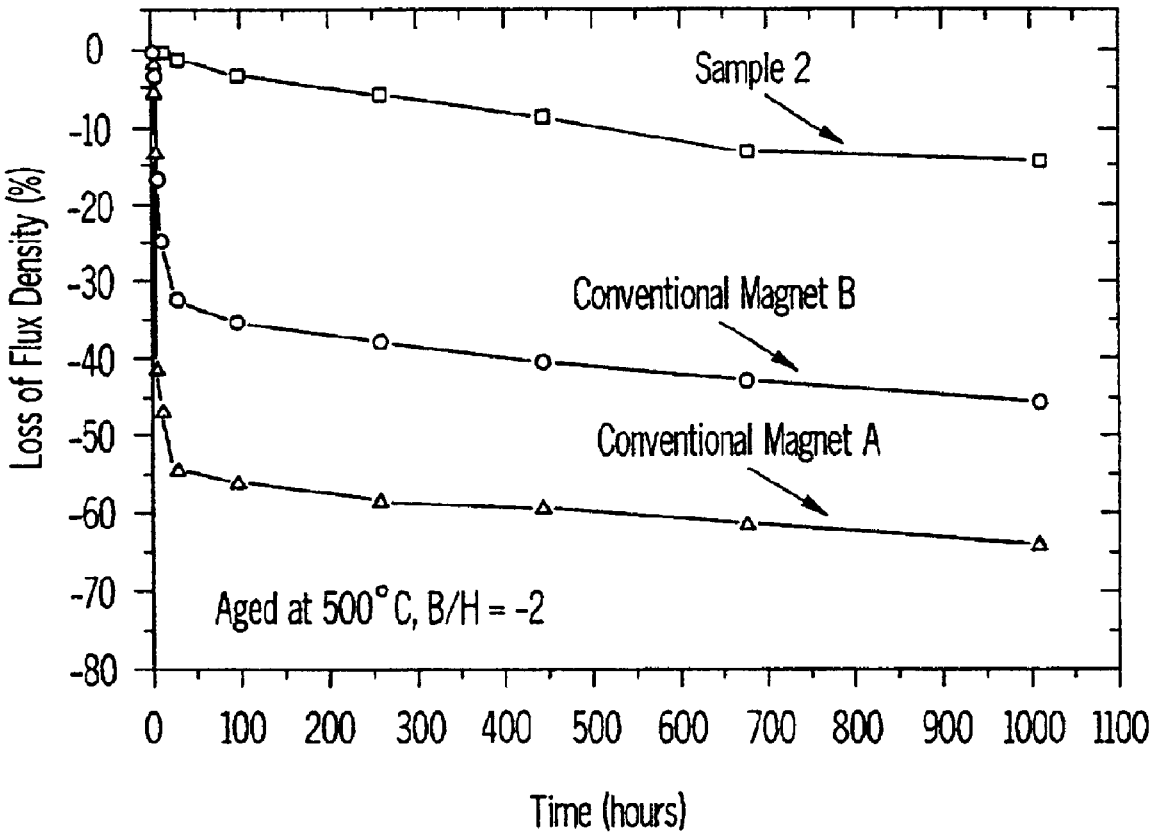
FIG. 10 is a graph illustrating long-term thermal stability test results at 500° C. for a magnet of the present invention and two conventional magnets.

As can be seen, the magnets of this invention are very stable at high temperatures. FIG. 10 shows long-term thermal stability test results for 500° C. for sample 2 of this invention and two conventional magnets.

Figure 11:
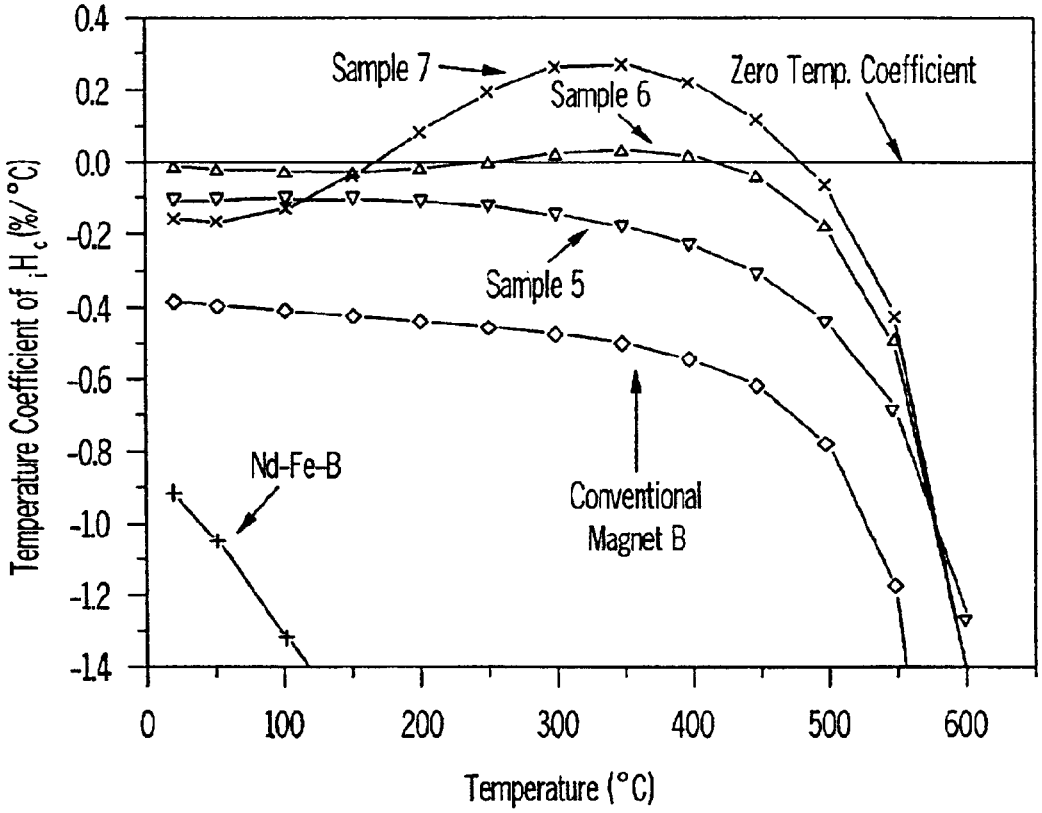
FIG. 11 is a graph illustrating the relationship of temperature coefficients of intrinsic coercivity ${}_iH_c$ [%/° C.] vs. temperature in ° C., for three magnets of the present invention compared to a conventional 2:17 magnet and a Nd—Fe—B magnet.

For conventional Sm-TM 2:17 magnets, the intrinsic coercivity has a large negative temperature coefficient. The temperature coefficient of intrinsic coercivity of a conventional 2:17 magnet at ~25° C. is −0.36%/° C. On heating, the intrinsic coercivity of 2:17 magnets drops sharply from their room temperature values of 20–35 kOe to 3–6 kOe at 400° C. By carefully adjusting compositions of Sm-TM magnets within the preferred ranges of the present invention, magnets with small negative or with near-zero, or even with large positive temperature coefficient of intrinsic coercivity can be achieved. FIG. 11 shows the relationship of temperature coefficients of intrinsic coercivity $_iH_c$ [%/° C.] vs. temperature in ° C., for three magnets of the present invention as described in samples 5, 6, and 7 in Table V compared to a conventional Sm-TM magnet and a Nd—Fe—B magnet. It should be noted that two magnets of the invention showed positive temperature coefficients (samples 6 and 7).

TABLE V

Magnets with varying levels of Co, Fe, Cu and T with varied temperature coefficients β of $_iH_c$ (%/° C.) $Sm(Co_wFe_vCu_xT_y)_z$

| Sample | Co (w) | Fe (v) | Cu (x) | T = Zr (y) | T/Sm (z) | β at 350° C. (%/° C.) |
|---|---|---|---|---|---|---|
| 5 | 0.805 | 0.09 | 0.08 | 0.025 | 7.69 | −0.17 |
| 6 | 0.795 | 0.09 | 0.09 | 0.025 | 7.14 | +0.02 |
| 7 | 0.843 | 0.04 | 0.09 | 0.027 | 7.26 | +0.28 |

The negative temperature coefficient of residual induction, $B_r$, which is characteristic of the alloys using only light rare earth elements, is counteracted by the positive temperature coefficient of the heavy rare earth elements in $RECo_5$ and $RE_2TM_{17}$. Light rare earth elements include all the rare earth elements with atomic numbers 39 and 57 through 63, such as Y, Sm, Pr, etc. Heavy rare earth elements include all those with atomic numbers form 64 through 71, such as Gd, Dy, and Er.

Sample 8 shown in Table VI is a temperature compensated magnet of the present invention with $T_M$=400° C. and a formula of $Gd_{0.33}Sm_{67}(Co_{73}Fe_{16}Cu_{08}Zr_{03})_{77}$. This magnet has low temperature coefficients α of $B_r$, β of $_IH_c$, and γ of $(BH)_{max}$ compared to conventional Sm-TM magnets as shown in Table VI.

TABLE VI

Temperature coefficients

| Sample | $T_M$ (° C.) | Br (kG) 25° C. | Br (kG) 200° C. | Average temp. coefficients (%/° C.) at 25° C.–200° C. α for $B_r$ | β For $_iH_c$ | γ $(BH)_{max}$ |
|---|---|---|---|---|---|---|
| 8 | 400 | 8.48 | 8.17 | −0.0209 | −0.210 | −0.064 |
| 1 | 400 | 10.02 | 9.27 | −0.0423 | −0.211 | −0.088 |
| B* | 330 | 10.72 | 9.95 | −0.0406 | −0.318 | −0.086 |

*B is prior art Sm-TM magnet with $T_M$ of 330° C.

The magnets of the present invention have the crystal structure of $Sm_2Co_{17}$ and typical 2:17 cellular and lamella microstructure and surprisingly smaller cell size with increasing $T_M$. Sample 2 with $T_M$ of 500° C. has a cell size of 78 nm, and a prior art Sm-TM magnet with $T_M$ of 330° C. has a cell size 123 nm, which is 60% larger than that of sample 2. Unexpectedly smaller cell sizes in the cellular and lamella structure provide stronger pinning force to resist thermal demagnetization at higher temperatures.

Tables I–VI and FIGS. 3–11 clearly show that by increasing Co content and adjusting the contents of other elements, (a) the temperature coefficient of $_IH_C$ is decreased, (b) the $_IH_C$ is increased at high temperatures, and (c) the maximum use temperature, $T_M$, is increased.

It will be obvious to those skilled in the art that various changes may be made without departing from the scope of the invention which is not considered limited to what is described in the specification.

What is claimed is:

1. A permanent magnet represented by the general formula $RE(Co_wFe_vCu_xT_y)_Z$ where RE is a rare earth element selected from the group consisting of Sm, Gd, Pr, Nd, Dy, Ce, Ho, Er, La, Y, Tb and mixtures thereof, and T is a transition metal selected from the group consisting of Zr, Hf, Ti, Mn, Cr, Nb, Mo, W, V, Ni, Ta, and mixtures thereof; said magnet exhibiting a substantially linear extrinsic demagnetization curve at a maximum operating temperature $T_M$ of between about 340° C. to about 700° C.

2. The permanent magnet of claim 1 wherein z is between about 6.5 and about 8.0, w is between about 0.50 and about 0.85, v is between 0.0 and about 0.35, x is between about 0.05 and about 0.20, and y is between about 0.01 and about 0.05.

3. The permanent magnet of claim 1 wherein the sum of w, v, x and y is 1 and z has a value between about 6.5 and about 8.0.

4. The permanent magnet of claim 1 having a temperature coefficient of intrinsic coercivity of between 0.30%/° C. and −0.30%/° C.

5. The permanent magnet of claim 1 wherein said substantially linear extrinsic demagnetization curve has a slope between 1.00 and 1.25.

6. The permanent magnet of claim 1 comprising from between about 22.5% and about 35.0% by weight samarium, between about 42% and about 65% by weight cobalt, between 0.0% and about 25% by weight iron, between about 2.0% and about 17.0% by weight copper, and between about 1.0% and about 5.0% by weight zirconium.

7. The permanent magnet of claim 1 comprising from between about 23.5% and about 28.0% by weight samarium, from between about 50% and about 60% by weight cobalt, from between about 4.0% and about 16% by weight iron, from between about 7.0% and about 12% by weight copper, and from between about 2.0% and about 4.0% by weight T.

8. The permanent magnet of claim 1 having a temperature coefficient of residual induction $B_r$ of between +0.02%/° C. to −0.040%/° C.

9. The permanent magnet of claim 1 comprising about 24.7% by weight Sm, about 57.8% by weight Co, about 7.0% by weight Fe, about 7.1% by weight Cu, and 3.4% by weight Zr+Nb.

10. The permanent magnet of claim 1 comprising about 26% by weight Sm, about 59.5% by weight Co, about 3.3% by weight Fe, 7.6% Cu, and 3.6% by weight Zr+Nb.

11. The permanent magnet of claim 1 comprising about 26% by weight Sm, about 61.0% by weight Co, about 1.0% by weight Fe, about 8.2% by weight Cu, and about 3.8% by weight Zr+Nb.

12. The permanent magnet of claim 1 having a cell size of ≦100 nm.

13. A permanent magnet represented by the general formula $RE(Co_wFe_vCu_xT_y)_Z$, where RE is a rare earth element selected from the group consisting of Sm, Gd, Pr, Nd, Dy, Ce, Ho, Er, La, Y, Tb, and mixtures thereof, T is a transition metal selected from the group consisting of Zr, Hf, Ti, Mn, Cr, Nb, Mo, W, V, Ni, Ta, and mixtures thereof, z is between about 6.5 and about 8.0, w is between about 0.50 and about 0.85, v is between 0.0 and about 0.35, x is between about 0.05 and about 0.20, and y is between about 0.01 and about 0.05.

14. A permanent magnet represented by the general formula $RE(Co_wFe_vCu_xT_y)_Z$ wherein the sum of w, v, x and y is 1; z has a value between about 6.5 and about 8.0, RE is a rare earth element selected from the group consisting of Sm, Gd, Pr, Nd, Dy, Ce, Ho, Er, La, Y, Tb, and mixtures thereof, and T is a transition metal selected from the group consisting of Zr, Hf, Ti, Mn, Cr, Nb, Mo, W, V, Ni, Ta and mixtures thereof.

15. A class of permanent magnets represented by the general formula $RE(Co_wFe_vCu_xT_y)_Z$, where RE is a rare earth element selected from the group consisting of Sm, Gd, Pr, Nd, Dy, Ce, Ho, Er, La, Y, Tb and mixtures thereof, and T is a transition metal selected from the group consisting of Zr, Hf, Ti, Mn, Cr, Nb, Mo, W, V, Ni, Ta, and mixtures thereof, wherein said magnets exhibit substantially linear extrinsic demagnetization curves at maximum operating temperatures up to 700° C.

* * * * *